US011412789B2

(12) United States Patent
Zeidan

(10) Patent No.: US 11,412,789 B2
(45) Date of Patent: Aug. 16, 2022

(54) MOTORCYCLE SAFETY HARNESS WITH SHOCK ABSORBERS AND CUSHIONS

(71) Applicant: Numan Zeidan, Hillsborough, CA (US)

(72) Inventor: Numan Zeidan, Hillsborough, CA (US)

( * ) Notice: Subject to any disclaimer, the term of this patent is extended or adjusted under 35 U.S.C. 154(b) by 354 days.

(21) Appl. No.: 16/006,809

(22) Filed: Jun. 12, 2018

(65) Prior Publication Data

US 2019/0008221 A1 Jan. 10, 2019

Related U.S. Application Data

(60) Provisional application No. 62/519,055, filed on Jun. 13, 2017.

(51) Int. Cl.
*A41D 13/015* (2006.01)
*A62B 35/00* (2006.01)

(52) U.S. Cl.
CPC ..... *A41D 13/0153* (2013.01); *A62B 35/0018* (2013.01); *A62B 35/0025* (2013.01); *A41D 2600/102* (2013.01)

(58) Field of Classification Search
CPC ..... A41D 13/0153; A41D 13/015; A41D 13/0518; A41D 13/0525; A41D 13/0531; A41D 13/0543; A41D 13/0568; A41D 13/055; A62B 35/0006; A61F 5/02; A61F 5/0102; A63B 71/12; A45F 3/14; A45F 3/10; A41F 19/00
USPC ..... 182/183.1, 3; 224/168; 602/16, 19
See application file for complete search history.

(56) References Cited

U.S. PATENT DOCUMENTS 836,802 A * 11/1906 Daniel ..... A61F 5/028 2/44
1,316,915 A * 9/1919 Meyer ..... A61F 5/028 602/19
4,173,973 A * 11/1979 Hendricks ..... A61F 5/024 602/19
5,840,051 A * 11/1998 Towsley ..... A61F 5/0125 602/19
6,397,402 B1 * 6/2002 Holland ..... A41D 13/0153 2/456
8,910,315 B1 * 12/2014 Stephens ..... A41D 27/20 2/102
2008/0313791 A1 * 12/2008 Nagely ..... A42B 3/0473 2/425
2010/0204630 A1 * 8/2010 Sandifer ..... A61F 5/026 602/19
2011/0072567 A1 * 3/2011 Duhame ..... A41D 13/015 2/466
2011/0118639 A1 * 5/2011 Tweardy ..... A61F 5/055 602/18
2012/0289878 A1 * 11/2012 Schwenn ..... A61F 5/0193 602/23
2014/0224849 A1 * 8/2014 Hiemenz ..... A42B 3/0473 224/271
2015/0047090 A1 * 2/2015 Cook ..... A41D 13/065 2/22
2015/0202072 A1 * 7/2015 Glazener ..... A61F 5/05883 602/18

(Continued)

*Primary Examiner* — Jillian K Pierorazio
(74) *Attorney, Agent, or Firm* — William C. Milks, III

(57) ABSTRACT

A motorcycle safety harness with shock absorbers and cushions channels shock waves caused by a motorcycle accident away from the vital organs of a motorcycle rider to the shoulders and thighs to reduce severe injuries to the rider and save lives.

19 Claims, 2 Drawing Sheets

(56) References Cited

U.S. PATENT DOCUMENTS

| | | | | |
|---|---|---|---|---|
| 2015/0328034 | A1* | 11/2015 | Ingimundarson | A61F 5/0193 602/16 |
| 2015/0366694 | A1* | 12/2015 | Bujold | A61F 5/0102 602/16 |
| 2016/0339583 | A1* | 11/2016 | Van Engelhoven | B25H 1/10 |

* cited by examiner

MOTORCYCLE SAFETY HARNESS WITH SHOCK ABSORBERS AND CUSHIONS

CROSS-REFERENCE TO RELATED PATENT APPLICATION

This application claims the benefit of U.S. Provisional Patent Application No. 62/519,055 filed on Jun. 13, 2017, entitled MOTORCYCLE SAFETY BELT WITH SHOCK ABSORBERS AND CUSHIONS, the disclosure of which is hereby incorporated herein in its entirety by this reference.

BACKGROUND OF THE INVENTION

1. Field of the Invention

The present invention relates to safety equipment and, more particularly, to safety equipment for motorcyclists. Specifically, various example embodiment in accordance with the present invention provide a motorcycle safety harness worn by each motorcycle driver and accompanying passenger to protect the vital organs of each person, including the skull and the brain, the neck and the spine, and the bones of the rib cage that encase the heart and the lungs, of a motorcycle rider, so that the risk of serious injury while riding a motorcycle is reduced.

2. Description of the Prior Art

Motorcycle accidents occur with high frequency. Not only are numerous motorcycle accidents reported by the media, the results of motorcycle accidents that are reported are horrific.

Motorcycle accidents routinely result in extreme bodily injuries and often the death of a motorcycle rider. The driver and any accompanying passenger face an unusually high degree of risk of physical harm, and the extent of injuries can be devastating. Motorcycle accidents cause injuries to the motorcyclist that include brain damage, neck and spine injuries, broken ribs, and other internal injuries.

The conventional helmet that is in use by motorcycle riders does not protect the motorcycle rider against injuries to the rider's torso or extremities. Although some motorcycles are now equipped with air bags, they are inadequate to protect a motorcycle rider who is thrown from the motorcycle in a collision or crushed by the motorcycle. Neither does the known motorcycle safety belt typically made out of leather and placed around the waist of a rider afford sufficient protection against having the motorcycle turn over on the motorcycle rider.

Consequently, the known prior art does not provide safety equipment to adequately protect a motorcycle rider from serious injury in the event of an accident. Therefore, improved equipment for motorcycle rider is needed.

SUMMARY OF THE INVENTION

In accordance with example embodiment of the present invention, a motorcycle safety harness is provided to transfer shock waves caused by a motorcycle accident to the shoulders and the thighs of the motorcyclist to reduce severe injuries to the skull and the brain, the neck and the spine, and the rib cage that protects the heart and the lungs. The motorcycle safety harness thus provides protection for the vital organs of a motorcyclist.

In accordance with an example embodiment of the present invention, the motorcycle safety harness preferably comprises a conventional helmet attached to an articulated torso shaft that extends the length of the neck and the spine of a motorcycle rider. The upper portion of the articulated torso shaft incorporates a first swivel joint to enable the motorcycle rider to move his or her head and neck. Shoulder rods are connected by hinges to the upper portion of the articulated torso shaft below the first swivel joint to transfer the shock wave of a motorcycle accident to the shoulders, and small shock absorbers are preferably connected to the ends of the shoulder rods. The motorcycle rider straps the shoulder rods to his or her shoulders when the motorcycle rider puts on the motorcycle safety harness. Two curved plates comprising a rib cage protector are connected by hinges to the middle portion of the articulated torso shaft and strapped together when the motorcycle rider puts on the motorcycle safety harness. The lower portion of the articulated torso shaft incorporates a second swivel joint to enable the motorcycle rider to move his or her lower torso. Thighs rods are connected by third and fourth swivel joints to the lower portion of the articulated torso shaft below the second swivel joint to transfer the shock wave of the motorcycle accident to the thighs of the motorcycle rider, and small shock absorbers are preferably connected to the ends of the thigh rods. The motorcycle rider straps the thigh rods to his or her thighs when the motorcycle rider puts on the motorcycle safety harness. Preferably, the articulated torso shaft, shoulder rods, rib cage protector, and thigh rods are cushioned with resilient material to absorb shock and make the motorcycle safety harness comfortable to wear.

BRIEF DESCRIPTION OF THE DRAWING

The various example embodiments of the present invention will be described in conjunction with the accompanying figures of the drawing to facilitate an understanding of the present invention. In the drawing.

DETAILED DESCRIPTION OF THE PREFERRED EXAMPLE EMBODIMENTS

Figure 1:
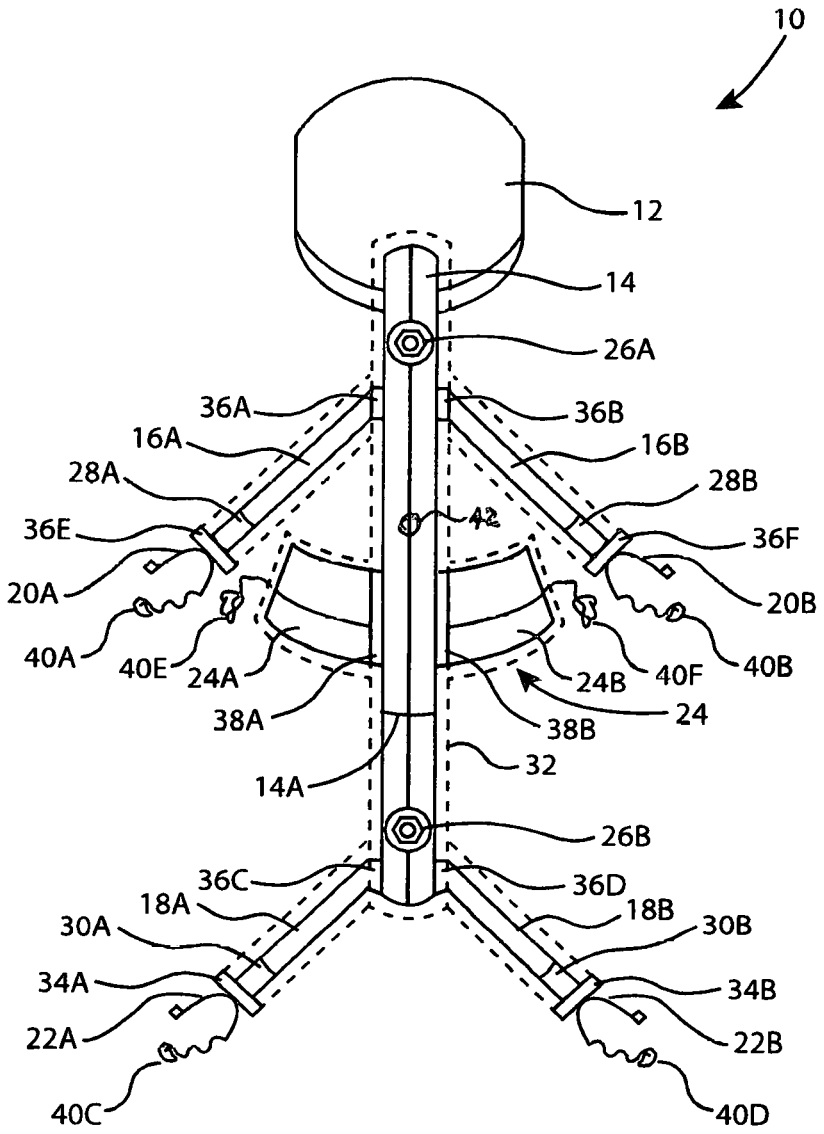
FIG. 1 is a elevational rear plan view illustrating an example embodiment of the motorcycle safety harness with shock absorbers and cushions in accordance with the present invention.
Figure 2:
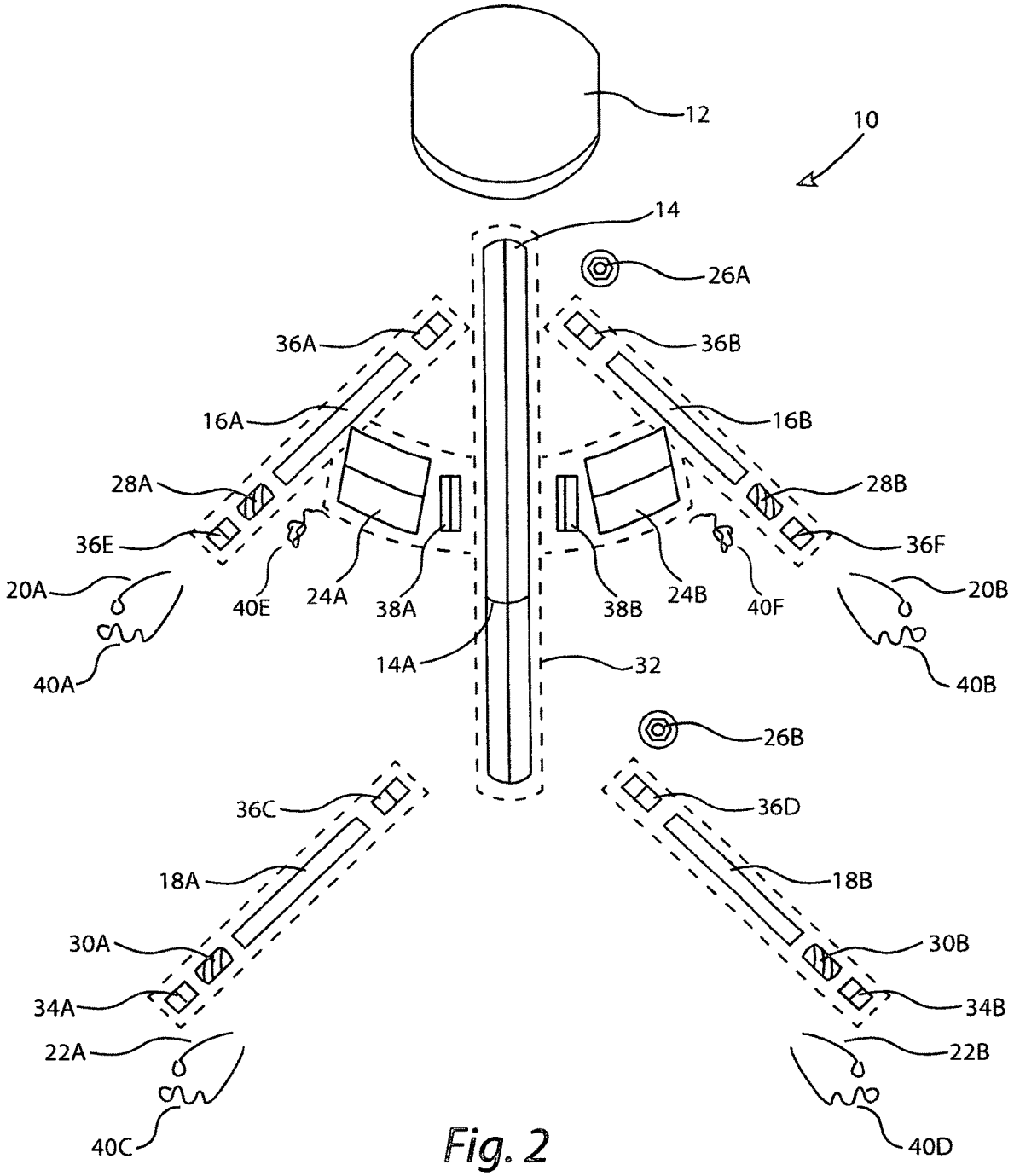
FIG. 2 is an exploded view of the motorcycle safety harness with shock absorbers and cushions shown in FIG. 1.

As shown in FIGS. 1 and 2, an example embodiment of the motorcycle safety harness in accordance with the present invention, generally indicated by the numeral 10, employs the principles of physics and physical laws of shock waves, which characterize how a type of propagated disturbance, namely, shock waves, carry energy and propagate through a physical mass.

Shock waves are formed by sudden compression of physical matter, for example, by an earthquake shifting the ground or a supersonic aircraft compressing the atmosphere, through which the shock waves travel (i.e., the ground or the atmosphere). Similarly, motorcycle accidents create shock waves and sudden compression of the body of an unprotected motorcycle rider, causing horrible injuries and even death to the motorcycle rider and destruction of the motorcycle.

Moving shock waves caused by a motorcycle accident typically result in shock waves propagating to a stationary medium, i.e., the motorcycle safety belt worn around the waist of the motorcycle rider. The shock waves caused by a motorcycle accident can be normal at 90° perpendicular to the body of the motorcycle rider or at an oblique angle to the body. The motorcycle safety harness 10 comprises a helmet attached to an articulated torso shaft 14, shoulder rods 16A and 16B, thigh rods 18A and 18B, and a rib cage protector 24 comprised of anatomically shaped hinged plates 24A and 24B to intercept the shock waves that would otherwise comprise the head and torso of the motorcycle rider and transfers the shock waves to less vulnerable portions on the body.

The motorcycle safety harness 10 in accordance with the example embodiments of the present invention reduces bodily injury to the motorcycle rider by dissipating the shock waves caused by a motorcycle accident through the rib cage protector 24, through the articulated torso shaft 14, through the shoulder rods 16A and 16B, through the thigh rods 18A and 18B to the shoulders and thighs of the motorcycle rider. In accordance with the example embodiments of the present invention, the motorcycle safety harness 10 dissipates shock waves caused by a motorcycle accident in the shoulders and the thighs of a motorcycle rider, away from vital organs such as the skull and the brain, the neck and the spine, and the heart and the lungs. The energy of the shock waves resulting from a motorcycle accident dissipates relatively quickly with distance from the point of impact. With the motorcycle safety harness 10, shock waves are channeled and directed away from the vital organs of the motorcycle rider and are dissipated in the shoulders and thighs.

Considered in more detail, FIGS. 1 and 2 show an example embodiment of the motorcycle safety harness 10. Preferably, the motorcycle safety harness 10 comprises a conventional helmet 12 to protect the skull and the brain of a motorcyclist. The helmet 12 is selectively attached or integrally connected to the articulated torso shaft 14 at the lower back of the helmet. Consequently, in the event of a motorcycle accident, the articulated torso shaft 14 transmits impact energy away from the skull and the brain.

As shown in FIG. 1, the articulated torso shaft 14 is approximately the length of the neck and the spine and is curved to approximate the shape of the spine of a motorcyclist. The articulated torso shat 14 is preferably constructed from a light weight metal, such as titanium, or from a formable or moldable material such as polycarbonate, carbon fiber, or fiberglass, to provide a rigid, strong, and light weight shaft. In accordance with an example embodiment, the articulated torso shaft 14 may comprise a locking hinge 14A so that the articulated torso shaft may be folded lengthwise to facilitate transport and storage of the motorcycle safety harness 10.

In accordance with an example embodiment, the articulated torso shaft 14 may be a compound shaft comprising a fixed portion and a telescoping portion comprising two telescoping sections, so that the length of the shaft is adjustable to the length of the neck and spine of a motorcyclist and held at the adjusted length by one or more set screws 42 or any other suitable mechanism to maintain the length adjustment to accommodate the size of the motorcyclist. In the example embodiment in which the articulated torso shaft 14 is a telescoping shaft, the locking hinge 14A is positioned below the telescoping sections.

The shoulder rods 16A and 16B and thigh rods 18A and 18B are preferably constructed from the same material as the articulated torso shaft 14. In accordance with an example embodiment, the shoulder rods 16A and 16B and/or thigh rods 18A and 18B may be telescoping shafts comprising two telescoping sections, so that the shafts are adjustable in length and held by one or more set screws or any other suitable mechanism to maintain the appropriate length adjustment to accommodate the size of the motorcyclist.

The rib cage plates 24A and 24B of the rib cage protector 24 are also preferably constructed from the same material as the articulated torso shaft 14, although they are preferably constructed from a moldable of formable material such as polycarbonate, carbon fiber, or fiberglass. Alternatively, each of the rib cage plates 24A and 24B can be constructed as one arched rib cage plate 24A for the left side of the torso and another arched rib cage plate 24B for the right side of the torso. Alternatively, each of the rib cage plates 24A and 24B may be constructed from multiple sections of metal welded together, for example.

The rib cage plates 24A and 24B of the rib cage protector 24 are attached with respective hinges 38A and 38B to the articulated torso shaft 14 so that the motorcyclist can swing them open and closed to put on the motorcycle safety harness 10. The use of hinges 38A and 38B allows the motorcyclist to comfortably put on the motorcycle safety harness 10 but does not affect the integrity and purpose of the safety harness or weaken the structure. Consequently, the hinges 38A and 38B do not have a negative effect but instead have a positive effect by facilitating the motorcyclist putting on the motorcycle safety harness 10 and enhancing the comfort and ease of use of the motorcycle safety harness. The hinges 38A and 38B also facilitate the portability of the safety harness 10, because they permit the rib cage plates 24A and 24B to be closed together to facilitate transporting or stowing the motorcycle safety harness 10.

In accordance with one example embodiment, the shoulder rods 16A and 16B are attached to the articulated torso shaft 14 by hinges 36A and 36B, respectively. The thigh rods 18A and 18B are attached to the articulated torso shaft 14 by swivel joints 36C and 36D, respectively. The hinges 36A and 36B and swivel joints 36C and 36D enable the motorcyclist to put on the motorcycle safety harness 10 with ease and wear the motorcycle safety harness with comfort. The hinges 36A and 36B and swivel joints 36C and 36D also allow the motorcyclist to fold the shoulder rods 16A and 16B and thigh rods 18A and 18B to facilitate transporting or stowing the motorcycle safety harness 10.

As shown in FIG. 1, the articulated torso shaft 14 is configured to swivel at the upper portion of the shaft by incorporating a swivel joint 26A so that the motorcyclist is able to turn his or her head and twist his or her neck left and right and up and down. Additionally, the articulated torso shaft 14 is further configured to swivel at the lower portion of the shaft by incorporating a swivel joint 26B so that the motorcyclist is able to turn his or her shoulders to which shoulder rods 16A and 16B are attached and bend at the waist. Also, the hinges 24A and 24B and swivel joints 26A and 26B enable the motorcyclist to sit and stand with ease and comfort.

Preferably, the shoulder rods 16A and 16B that are connected at the proximal ends to the articulated torso shaft 14 have respective shock absorbers 28A and 28B connected to the distal ends of the shoulder rods, as shown in FIG. 1. Likewise, the thigh rods 18A and 18B that are connected at the proximal ends to the articulated torso shaft 14 have respective shock absorbers 30A and 30B connected to the distal ends of the thigh rods.

As shown in FIG. 1, a strap or belt 40A and a clasp or buckle 20A that are connected at the distal end of the shoulder rod 16A or shock absorber 28A are provided to attach the shoulder rod 16A to the motorcyclist's left shoulder by passing the strap or belt 40A under the motorcyclist's left arm and connecting the strap or belt 40A to the clasp or buckle 20A. Similarly, a strap or belt 40B and a clasp or buckle 20B connected at the distal end of the shoulder rod 16B or shock absorber 28B are provided to attach the shoulder rod 16B to the motorcyclist's right shoulder by passing the strap or belt 40B under the motorcyclist's right arm and connecting the strap or belt 40B to the clasp or buckle 20B.

Also, a strap or belt 40C and a clasp or buckle 22A connected at the distal end of the thigh rod 18A or shock absorber 30A are provided to attach the thigh rod 18A to the motorcyclist's left thigh by passing the strap or belt 40C around the motorcyclist's left thigh and connecting the strap or belt 40C to the clasp or buckle 22A. Similarly, a strap or belt 40D and a clasp or buckle 22B connected at the distal end of the thigh rod 18B or shock absorber 30B are provided to attach the thigh rod 18B to the motorcyclist's right thigh by passing the strap or belt 40D under the motorcyclist's right leg and connecting the strap or belt 40D to the clasp or buckle 22B. Additionally, a strap or belt 40E is connected to the rib cage plate 24A and a clasp or buckle 40F is connected to the rib cage plate 24B. The rib cage protector 24 is secured around the motorcyclist's rib cage by connecting the strap or belt 40E to the clasp or buckle 40F. When the motorcyclist puts on the motorcycle safety harness 10, the straps or belts 40A, 40B, 40C, 40D, and 40E and the respective clasps or buckles 20A, 20B, 22A, 22B, and 40F are used to secure the motorcyclist's shoulders, thighs, and torso to the motorcycle safety harness. The interlocking straps or belts 40A, 40B, 40C, 40D, and 40E and clasps or buckles 20A, 20B, 22A, 22B, and 40F are made of materials such as leather, synthetic rubber, or microfibers that are strong, light, and comfortable. The straps or belts 20A and 20B for the shoulders and 22A and 22B for the thighs may be flexible and semicircular in shape for a comfortable fit to accommodate the motorcyclist and can be made of a combination of materials such as leather or synthetic rubber or any other resilient material which contacts the motorcyclist on the underside, and a more rigid, flexible material on the outside such as a flexible strip of light weight metal or carbon fiber vinyl for added strength.

As shown in FIGS. 1 and 2, in accordance with an example embodiment the main elements of the motorcycle safety harness 10 with the exception of the helmet 12 are preferably cushioned on the exterior by being covered with resilient material 32 as indicated by the dashed line. For example, the resilient material may be rubber, neoprene rubber, or high density foam having a thickness and elastic quality to absorb the shock waves created by a motorcycle accident to further reduce injuries, as well as to cushion the main elements of the motorcycle safety harness so that it is comfortable to wear.

The motorcycle safety harness 10 has many advantages. First, attaching the helmet 12 to the articulated torso shaft 14 prevents the helmet from being dislodged from the head of a motorcycle rider during an accident. Second, the motorcycle safety harness 10 protects the vital organs of the torso of a motorcyclist during an accident, reducing injuries and death. Third, the motorcycle safety harness 10 is constructed of light weight metal such as titanium or polycarbonate, carbon fiber, or fiberglass and is portable and easily transported and stowed. Fourth, the use of articulated and hinged elements makes the motorcycle safety harness 10 easy for a motorcyclist to put on and to take off. Fifth, because the elements of the motorcycle safety harness 10 are cushioned, the motorcycle safety harness 10 is very comfortable to wear. Sixth, the motorcycle safety harness 10 is worn on the outside of the motorcyclist's outerwear to further reduce the effect of shock waves oat the motorcyclist created by a motorcycle accident. Seventh, the motorcycle safety harness 10 is easily folded with the use of hinges and swivel joints to transport or stow the motorcycle safety harness after a ride. Eight, because the use of shock absorbers and cushions such as springy rubber absorb shock waves and buffer the motorcyclist from injuries, the motorcyclist is more confident and less worried due to having the added protection provided by the motorcycle safety harness 10. Ninth, the articulated torso shaft 14 is preferably adjustable in length and contoured to the shape of the spine of the motorcyclist which makes the motorcycle safety harness 10 comfortable to wear. Tenth, the shoulder rods 16A and 16B and thigh rods 18A and 18B may be adjustable as well for ease of use and comfort of the motorcyclist without compromising the integrity of the motorcycle safety harness 10. Eleventh, the motorcycle safety harness 10 can be made in any size (e.g., small, medium, large, and extra-large) as in the case of motorcycle jackets to accommodate the size of the motorcycle rider. Twelfth, the motorcycle safety harness 10 is a lifesaving apparatus that channels the shock waves created by a motorcyclist accident away from the vital organs of the motorcyclist to be dissipated in the shoulders and the thighs.

The example embodiment in accordance with the present invention described above are provided by way of example only, and various modifications which will be apparent to persons skilled in the art are contemplated. For example, swivel joints may be substituted for the hinges 36A and 36B to connect the respective shoulder rods 16A and 16B to the articulated torso shaft 14. Also, the motorcycle safety harness has other uses, for example, by bicyclists, mountain climbers, as well as other uses. Accordingly, the scope of the present invention can only be ascertained with reference to the appended claims.

What is claimed is:

1. A safety harness worn by a user, comprising:

a helmet;

a rigid torso shaft connected to the helmet, wherein the rigid torso shaft has a length which is approximated to the length of the neck and the spine of the user;

a first swivel joint incorporated into an upper portion of the rigid torso shaft to enable the user to move his or her head and neck;

a pair of shoulder rods having first and second ends;

a pair of hinges to connect the respective first ends of the shoulder rods to the upper portion of the rigid torso shaft below the first swivel joint;

means to attach the respective shoulder rods to the shoulders of the user;

a rib cage protector hingedly connected to a middle portion of the rigid torso shaft;

a second swivel joint incorporated into a lower portion of the rigid torso shaft to enable the user to move his or her torso and legs;

a pair of thigh rods having first and second ends;

third and fourth swivel joints to connect the respective first ends of the thigh rods to the lower portion of the rigid torso shaft below the second swivel joint; and means to attach the respective thigh rods to the thighs of the user;

whereby impact force to the torso of the user is transferred to the thighs of the user.

2. The safety harness of claim 1, further comprising a pair of shock absorbers connected to the respective second ends of the shoulder rods.

3. The safety harness of claim 1 wherein the means to attach the respective shoulder rods to the shoulders of the user comprise a pair of straps and clasps or a pair of belts and buckles.

4. The safety harness of claim 1 wherein the rib cage protector hingedly connected to the middle portion of the rigid torso shaft comprises first and second arched plates having first and second ends, respectively, wherein the first ends of the plates are connected by respective first and second hinges to the middle portion on opposite sides of the rigid torso shaft and the second ends are selectively connected together by a strap and clasp or a belt and buckle respectively connected to the second ends of the plates when the user puts on the safety harness.

5. The safety harness of claim 1, further comprising a pair of shock absorbers connected to the respective second ends of the thigh rods.

6. The safety harness of claim 1 wherein the means to attach the respective thigh rods to the thighs of the user comprise a pair of straps and clasps or a pair of belts and buckles.

7. The safety harness of claim 1, further comprising resilient material attached to the rigid torso shaft, shoulder rods, rib cage protector, and thigh rods.

8. The safety harness of claim 1 wherein the rigid torso shaft comprises a fixed portion and a telescoping portion comprising two rigid telescoping sections, so that the length of the rigid torso shaft is adjustable to the length of the neck and spine of the user, and further comprising one or more set screws to maintain the length adjustment.

9. The safety harness of claim 8, further comprising a locking hinge incorporated into the fixed portion of the rigid torso shaft.

10. The safety harness of claim 1, further comprising a locking hinge incorporated into the rigid torso shaft between the rib cage protector and the second swivel joint.

11. A safety harness worn by a user, comprising:

a unitary rigid torso shaft, wherein the unitary rigid torso shaft has a length which is approximated to the length of the neck and the spine of the user;

a first swivel joint incorporated into an upper portion of the unitary rigid torso shaft to enable the user to move his or her head and neck;

a pair of shoulder rods having first and second ends;

a pair of hinges to connect the respective first ends of the shoulder rods to the upper portion of the unitary rigid torso shaft below the first swivel joint;

means to attach the respective shoulder rods to the shoulders of the user;

a rib cage protector hingedly connected to a middle portion of the unitary rigid torso shaft;

a second swivel joint incorporated into a lower portion of the unitary rigid torso shaft to enable the user to move his or her torso and legs;

a pair of thigh rods having first and second ends;

third and fourth swivel joints to connect the respective first ends of the thigh rods to the lower portion of the unitary rigid torso shaft below the second swivel joint; and means to attach the respective thigh rods to the thighs of the user;

whereby impact force to the torso of the user is transferred to the thighs of the use.

12. The safety harness of claim 11, further comprising a pair of shock absorbers connected to the respective second ends of the shoulder rods.

13. The safety harness of claim 11 wherein the means to attach the respective shoulder rods to the shoulders of the user comprise a pair of straps and clasps or a pair of belts and buckles.

14. The safety harness of claim 11 wherein the rib cage protector hingedly connected to the middle portion of the unitary rigid torso shaft comprises first and second arched plates having first and second ends, respectively, wherein the first ends of the plates are connected by respective first and second hinges to the middle portion on opposite sides of the unitary rigid torso shaft and the second ends are selectively connected together by a strap and clasp or a belt and buckle respectively connected to the second ends of the plates when the user puts on the safety harness.

15. The safety harness of claim 11, further comprising a pair of shock absorbers connected to the respective second ends of the thigh rods.

16. The safety harness of claim 11 wherein the means to attach the respective thigh rods to the thighs of the user comprise a pair of straps and clasps or a pair of belts and buckles.

17. The safety harness of claim 11, further comprising resilient material attached to the unitary rigid torso shaft, shoulder rods, rib cage protector, and thigh rods.

18. The safety harness of claim 11 wherein the unitary rigid torso shaft comprises a first portion and a second portion and a locking hinge interconnected between the first and second sections.

19. The safety harness of claim 11, further comprising a locking hinge incorporated into the unitary rigid torso shaft between the rib cage protector and the second swivel joint.

* * * * *